United States Patent [19]

Salooja

[11] 4,375,949

[45] Mar. 8, 1983

[54] METHOD OF AT LEAST PARTIALLY BURNING A HYDROCARBON AND/OR CARBONACEOUS FUEL

[75] Inventor: Kailash C. Salooja, Reading, England

[73] Assignee: Exxon Research and Engineering Co., Florham Park, N.J.

[21] Appl. No.: 220,747

[22] Filed: Dec. 29, 1980

Related U.S. Application Data

[63] Continuation of Ser. No. 948,318, Oct. 3, 1978, abandoned.

[51] Int. Cl.[3] ..... E23C 11/02

[52] U.S. Cl. ..... 431/7; 431/170; 431/328; 431/351

[58] Field of Search ..... 431/3, 7, 8, 9, 10, 431/328, 170, 351

[56] References Cited

U.S. PATENT DOCUMENTS

| | | | |
|---|---|---|---|
| 3,376,098 | 4/1968 | Pryor | 431/10 |
| 3,832,122 | 8/1974 | La Haye | 431/10 |
| 3,928,961 | 12/1975 | Pfefferle | 431/7 X |
| 4,007,002 | 2/1977 | Schirmer | 431/10 |
| 4,047,877 | 9/1977 | Flanagan | 431/8 |
| 4,088,435 | 5/1978 | Hindin et al. | 431/7 |
| 4,197,701 | 4/1980 | Boyum | 431/7 X |

FOREIGN PATENT DOCUMENTS

| | | |
|---|---|---|
| 2442170 | 3/1976 | Fed. Rep. of Germany . |
| 2375543 | 7/1978 | France . |
| 1425122 | 2/1976 | United Kingdom . |
| 1578665 | 11/1980 | United Kingdom . |

*Primary Examiner*—Samuel Scott
*Assistant Examiner*—Margaret A. Focarino
*Attorney, Agent, or Firm*—H. A. Somers; Henry E. Naylor

[57] ABSTRACT

A method of at least partially burning a hydrocarbon and/or carbonaceous fuel in order to yield hot gaseous products of relatively low pollutant content, in which the fuel is partially burned in a first stage flame under such conditions that the partially combusted fuel has a temperature in the range 800° to 1600° C., (e.g., about 1150° C.) and is substantially free of smoke and/or carbon, bringing the partially combusted fuel at 800° to 1600° C. into contact with a substantially non-volatile catalyst (19) which is active for reducing the amount of $NO_x$ in the partially combusted fuel, and then at least partially burning the partially combusted fuel, after contact with the catalyst (19) in a second stage flame to yield the desired low pollutant hot gaseous products. Preferably one or both of the said flames burns in contact with a substantially non-volatile catalyst (25, 23) to reduce still further the $NO_x$ content of the final gaseous products. The preferred non-volatile catalysts (19, 25, 23) comprise either a mixture of iron and chromium oxides or cobalt oxide.

10 Claims, 11 Drawing Figures

METHOD OF AT LEAST PARTIALLY BURNING A HYDROCARBON AND/OR CARBONACEOUS FUEL

This is a continuation of application Ser. No. 948,318, filed Oct. 3, 1978, now abandoned.

The present invention relates to a method of at least partially burning a hydrocarbon and/or carbonaceous fuel.

The growing concern about both energy conservation and atmospheric pollution demands that combustion systems be operated with maximum combustion efficiency (with minimum excess air) and without any emission of pollutants. The two goals, however, are not readily compatible, and indeed have proved difficult to realize. This is because any reduction in excess air to promote combustion efficiency increases smoke, carbon monoxide and unburned hydrocarbons, and often also oxides of nitrogen ($NO_x$).

The present invention relates to a system and method in which both of the foregoing objectives can be achieved, not just with relatively clean-burning gaseous and light distillate fuels but also with fuel oils. The system and method basically involve staged combustion, as described below, in which improvements have been made in the design of the combustion system, and catalysts used in different stages. Conventional staged combustion involved firing of all the fuel in the first stage with a sub-stoichimetric quantity of air and the injection in the second stage of sufficient air to complete combustion. Such systems have been claimed to reduce $NO_x$ by ca 50%, but they usually render the control of other pollutants, notably carbon, more difficult.

According to the invention, in one aspect, fuel is partly burned in a first stage flame to yield hot substantially carbon (or smoke-)free partly-combusted fuel or first stage product, the latter being contacted with a catalyst which is active for promoting the conversion of nitrogen oxide(s) in the partly-combusted fuel or first stage product to nitrogen, the partly-combusted fuel (or first stage product), after contact with the catalyst, then being at least partially burned in a second stage flame to yield hot gaseous products having a low nitrogen oxide (and other pollutants) content. The invention, in another aspect, comprises a method of burning a hydrocarbon and/or carbonaceous fuel comprising the following steps in sequence:

(a) partially burning the fuel in a first stage flame and producing a substantially carbon-free or smoke free partially combusted gas phase fuel at a temperature of at least 800° C.;

(b) contacting the said partially combusted gaseous phase fuel with a solid, substantially non-volatile catalyst which is active for reducing the amount of nitrogen oxide(s) in the partially combusted fuel, the contacting being effected at a temperature of at least 800° C.; and (c) at least partially burning the partially combusted fuel in a second stage flame to yield hot gaseous products of relatively low pollutant content.

The temperature at which the partly-combusted fuel or first-stage product contacts the catalyst may be in the range of from 800° to 1600° C., preferably 900° to 1400° C., more preferably 1000° C. to 1300° C., although the actual temperature will depend upon the fuel and on the amount of oxygen supplied for combustion in the first stage flame, and on the amount of nitrogen introduced with the oxygen.

In order to reduce still further the nitrogen oxide content of the products, a catalyst to reduce or inhibit the formation of nitrogen oxide may be located within the flame of the first stage and/or within the flame of the second stage. Preferably, a catalyst for reducing or inhibiting $NO_x$ formation is located within the flames of both stage. The catalyst for the, or each, stage, is preferably so disposed within the flame as to contact or be contacted by the hottest region of the flame usually at between 30% and 45% of the flame length from its upstream end.

The catalyst employed between the stages, and the catalyst(s) used in the first and/or second stages may be the same or different. They are preferably selected from substances consisting of or containing the elements or compounds (e.g., the oxides) of chromium, iron, cobalt, nickel, molybdenum, tungsten, silicon, aluminium, magnesium, calcium, manganese, barium, strontium, neodymium, vanadium, alkali metals or any mixture thereof. A preferred catalyst, for cost-effectiveness, is Fe/Cr, although cobalt may alternatively be favoured. The total amount of oxygen supplied in relation to the fuel may be a substoichiometric amount so that the hot gaseous products contain combustible material, or a substantially stoichiometric amount so that the hot gaseous products substantially comprise a flue gas containing no free oxygen or combustible material, or a superstoichiometric amount so that a flue gas containing free excess oxygen is produced.

The part-combustion in the first stage is preferably performed in any way which produces partly combusted fuel (or first stage products) which is free of, or substantially free of, carbon or smoke. The second stage (part-) combustion is also preferably performed in a manner which produces substantially no carbon or smoke.

In a preferred method of effecting the first and/or second stage (part-) combustion without the production of smoke and/or carbon, a technique, herein referred to as the "anti-smoke technique", is preferably employed. In the practice of the anti-smoke technique, the periphery of the frame is laterally confined or bounded for at least part of its length by a surrounding combustion chamber which reduces the greatest cross-sectional dimensions of at least a portion of the thus laterally confined part of the flame relative to the cross-sectional dimensions that the flame would otherwise have were it not laterally confined. Preferably the cross-sectional dimensions of the flame are reduced (preferably where the flame cross-sectional dimensions are greatest), and the dimensional reduction is preferably in the range of from 1 to 6.5 cms, more preferably 1.25 to 6.35 cms, and preferably no more than 20% of the unconfined cross-sectional plane. The confinement of part of the flame by the combustion chamber causes deflection and reflection, by the hot walls of the combustion chamber, of reactive flame species that would otherwise be quenched. The recirculation of reactive flame species back into the flame to promote efficient flame reactions may be further promoted by the provision of one or more baffles of suitable shape, which are contacted by the respective flame. Preferably such baffles extend unwardly from the wall of the combustion chamber across no more than part of the cross-section of the flame. The anti-smoke technique is more fully described later in this specification.

Preferably, the total pressure drop through the combustion chamber is no greater than 25.4 cms of water.

The second stage combustion may be effected by mixing an oxygen-containing gas (such as air) into the hot partly combusted fuel or first-stage products following contact with the $NO_x$-reducing catalyst between the first and second stage combustion stages.

By effecting the part-combustion in the first stage flame as described, the $NO_x$ production in the absence of all the catalysts which might be employed in the practice of this invention is up to about 60% less than the $NO_x$ production by single stage combustion. By employing catalysts active for reducing the $NO_x$ content of hot gases between the first and second flame stages, and also within the first and second flame stages, a reduction in the $NO_x$ concentration of over 90% to an innocuously low concentration may be realized. The foregoing combustion may be effected at very high fuel to oxygen ratios with markedly reduced carbon or smoke formation from the first stage flame when the anti-smoke technique is employed, and combustion with substantially no excess air may be effected in the second stage flame with substantially no carbon or smoke formation particularly, but not essentially, when the anti-smoke technique is applied to the second stage flame.

When the fuel contains sulfur, operation with no, or very little, excess air reduces the formation of $SO_3$, most of the sulfur appearing in the flue gases as $SO_2$ with a correspondingly advantageous increase in the acid dew point temperature and potential improvements for additional heat recovery.

The invention is now described in more detail, and with reference to the accompanying drawings, in which.

Figure 2:
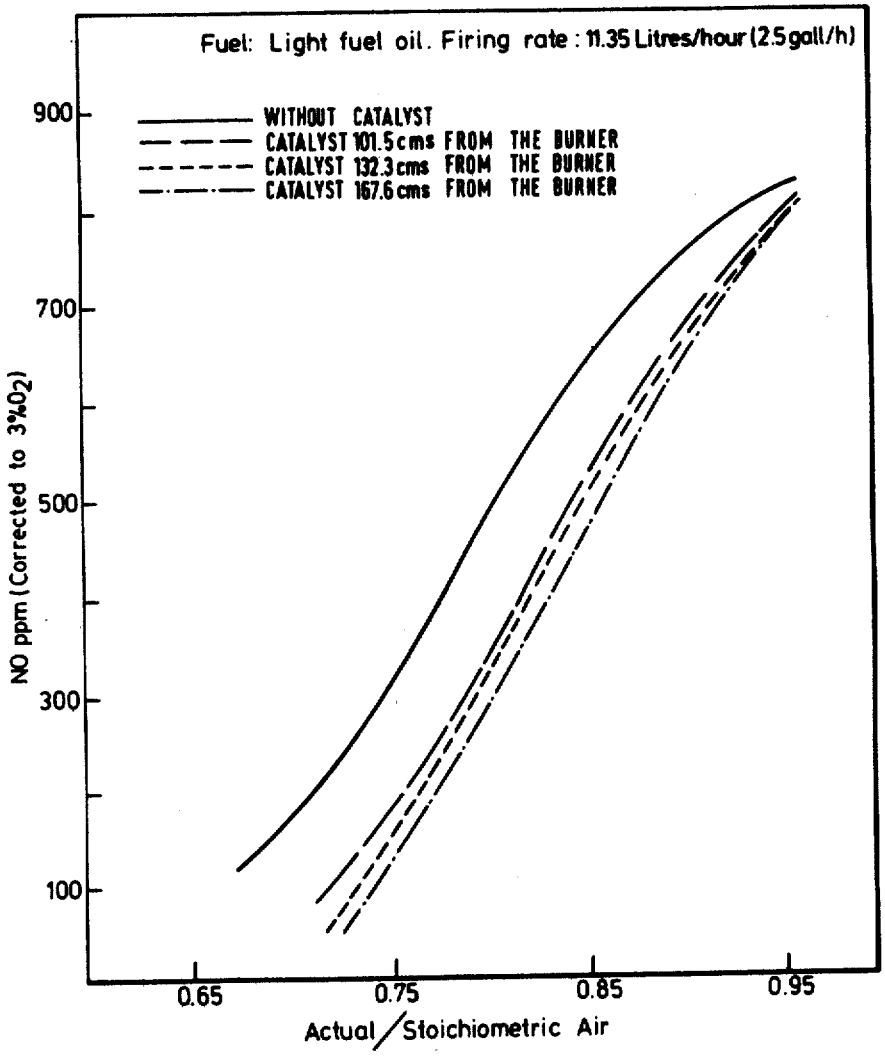
FIG. 2 is a graphical representation of the effect of catalysts on nitrogen oxides formation at different fuel/air ratios for different positions of the catalysts between the first and second stage flames.
Figure 3:
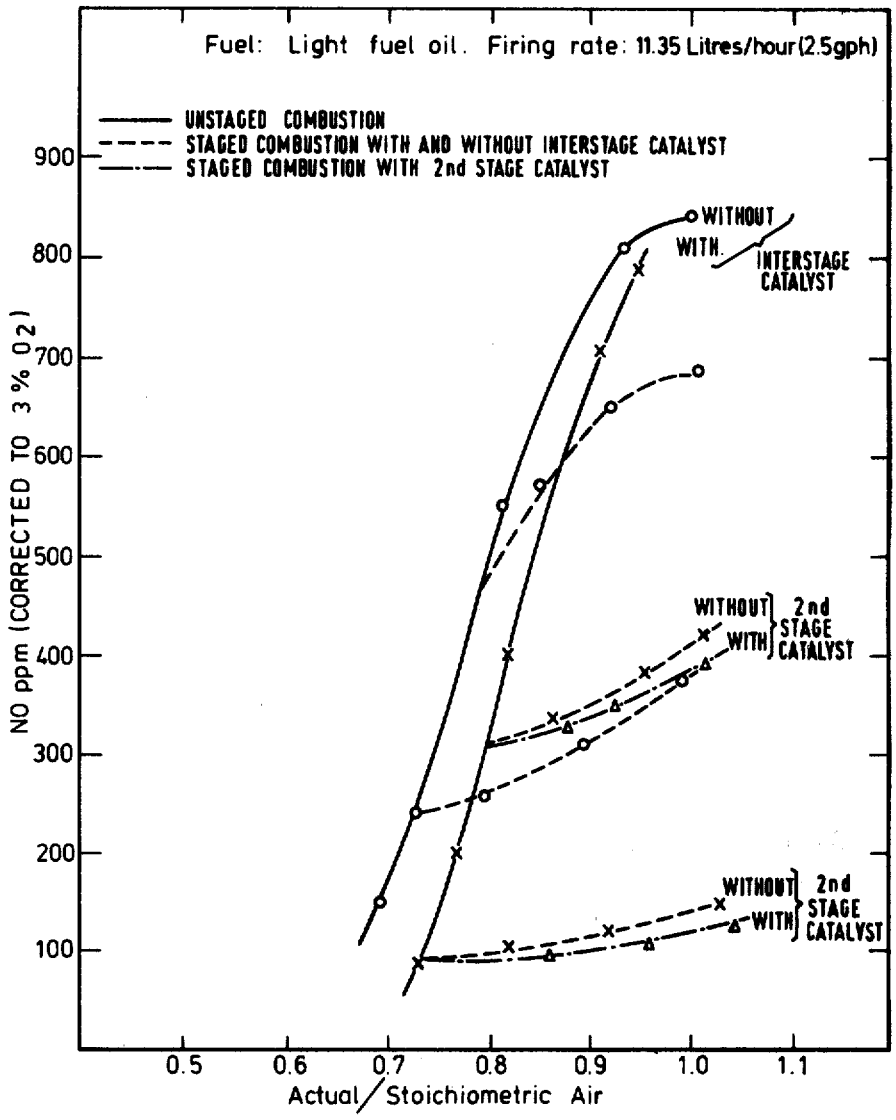
FIG. 3 is a graphical representation of the effect of a catalyst in the second stage flame on the $NO_x$ content of the flue gas at different fuel/air ratios.
Figure 4:
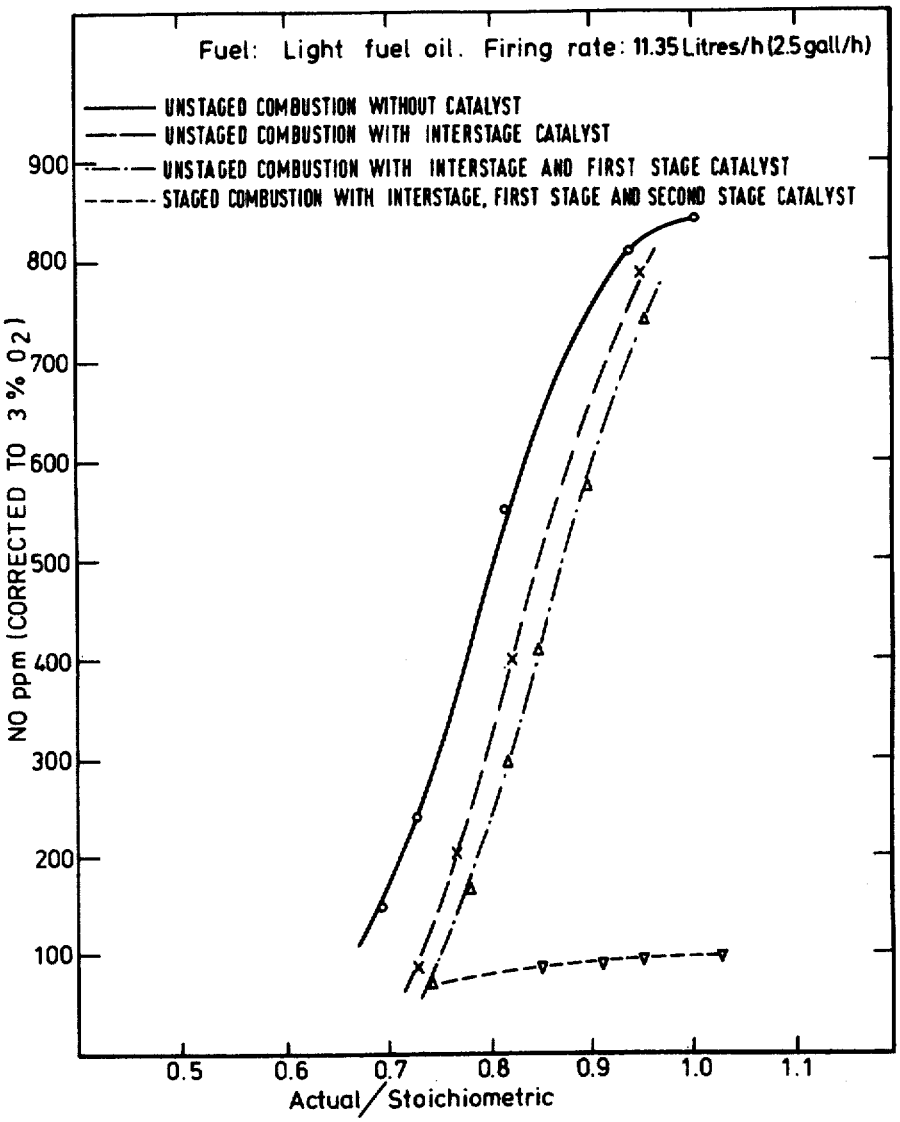
FIG. 4 is a graphical representation of the effect of a catalyst in the first stage flame on the $NO_x$ content of the flue gas at different fuel/air ratios.

In FIGS. 2, 3 and 4, the ordinate shows the NO concentration in parts per million (ppm) by volume corrected to 3% $O_2$.

Figure 1:
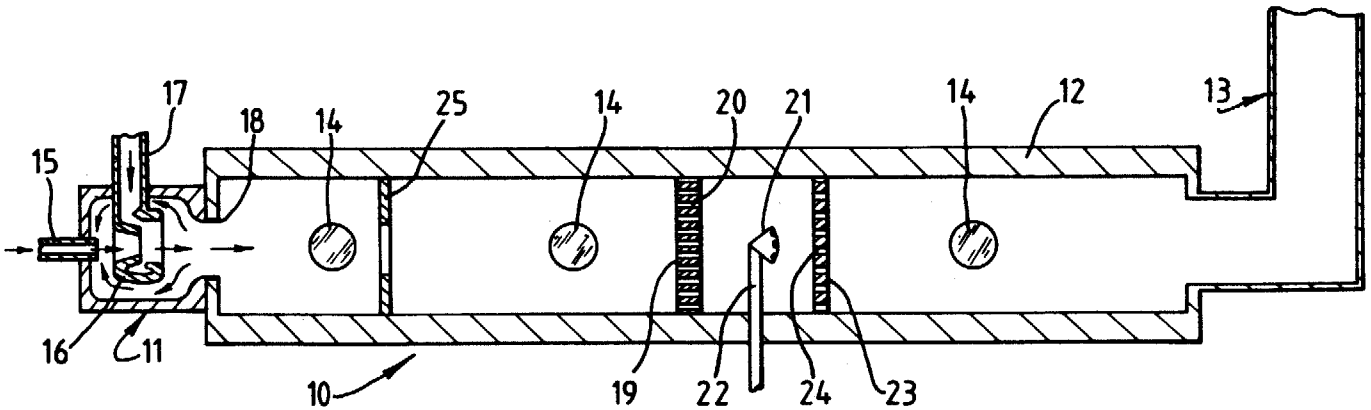
FIG. 1 is a schematic diagrammatic cross-sectional elevation of the principal parts of an apparatus for effecting combustion or part-combustion of a fuel in accordance with the method of the invention.

Referring first to FIG. 1, the schematic diagram shows apparatus, generally indicated by reference 10, comprising a burner 11 in which fuel is burned to produce a flame (not indicated), a cylindrical refractory-lined combustion chamber 12 which receives the flame produced by the burner at one end, and from which combustion or part-combustion products are discharged at the other end to a flue pipe 13. The combustion chamber is provided with a number of viewing ports 14. Fuel, preferably a commonly-used liquid fuel such as light fuel oil or gas oil, is passed into the burner 11 via injector tube 15 and air is passed into an annular air supply ring 16 via conduit 17. The air mixes with atomized oil and the latter burns in the burner 11 to produce a flame which passes to the upstream end of the combustion chamber 12. Recirculation of some of the burning gases takes place around the air ring, the recirculation serving to improve the quality of combustion.

The apparatus 10 depicted is arranged for combustion of the fuel in two stages, the first stage combustion being effected under fuel-rich conditions, and the partial combustion flame entering the upstream end of the combustion chamber 12 via an orifice bounded by walls 18 treated so as to contain a substantially non-volatile catalyst active for reducing carbon and/or smoke. In this instance the catalyst is either a mixture of iron and chromium oxides or cobalt oxide.

The internal diameter of the combustion chamber 12 is chosen to be less than the natural or unconfined maximum diameter of at least a portion of the first stage flame produced by the burner 11 so that reactive flame species which promote combustion reactions are deflected and reflected back into the first stage flame by the hot walls of the combustion chamber 12 rather than being quenched, thereby enhancing the efficiency of partial combustion of the fuel in the first stage flame.

The hot substantially carbon-free combustible gases at a temperature in the range of from 1000° to 1300° C., e.g. about 1250° C., produced in the first stage flame, pass down the combustion chamber into contact with an orificed refractory member 19 extending across the chamber 12 and which is impregnated with, and coated with, substantially non-volatile catalysts which are active for reducing the content of $NO_x$ in the gases. In this instance, the catalyst is either a mixture of iron and chromium oxides or of cobalt oxide impregnated in and supported on a silica (approximately 33%), alumina (approximately 65%) refractory material. The member 19 has a large number of orifices 20 therethrough to minimize the pressure drop. The gases after passage through the orifices 20 in the member 19 are mixed with air furnished from an air injection head 21 which is connected to a source of air by a conduit 22 and ignites to form a second stage flame (not shown) which may burn with insufficient, sufficient or an excess of air for complete combustion of the combustible gases. The diameter of the combustion chamber 12 is chosen to be narrower than the natural or unconfined diameter of the second stage flame so as to promote efficient (part-) combustion with substantially no carbon or smoke formation even at low air/gas ratios.

The second stage flame contacts a refractory member 23 having a large number of perforations 24 therethrough which member is impregnated and coated with a substantially non-volatile catalyst which is active or reducing the $NO_x$ content of the flame gases and/or for inhibiting the formation of $NO_x$. The catalyst may be, for example, either a mixture of iron and chromium oxides or cobalt oxide.

The resulting hot gases, which may be reducing, neutral or oxidizing, are of low carbon or smoke content and of low $NO_x$ content.

The advantageous effects caused by confining at leaast part of each of the first and second stage flames by the combustion chamber so as to reduce their diameters may be enhanced by providing one or more baffles which is or are contacted by one or both of the flames. Such baffle(s) promote recirculation of reactive species in the flame(s) and thereby enhance the efficiency of the flame reactions and thereby reduce the formation of $NO_x$ and also reduce the formation of smoke and/or carbon. The or each baffle may take any form provided the pressure drop caused thereby is acceptably low. One such baffle 25 in the first stage flame is in the form of an annulus with a central hole. The baffle 25 is most effective for enhancing the flame reactions when it is disposed less than half way down the first stage flame from its upstream end at the exit from the burner 11, and more preferbly when it is disposed about 33% of the first stage flame length from the burner exit.

Figure 1A:
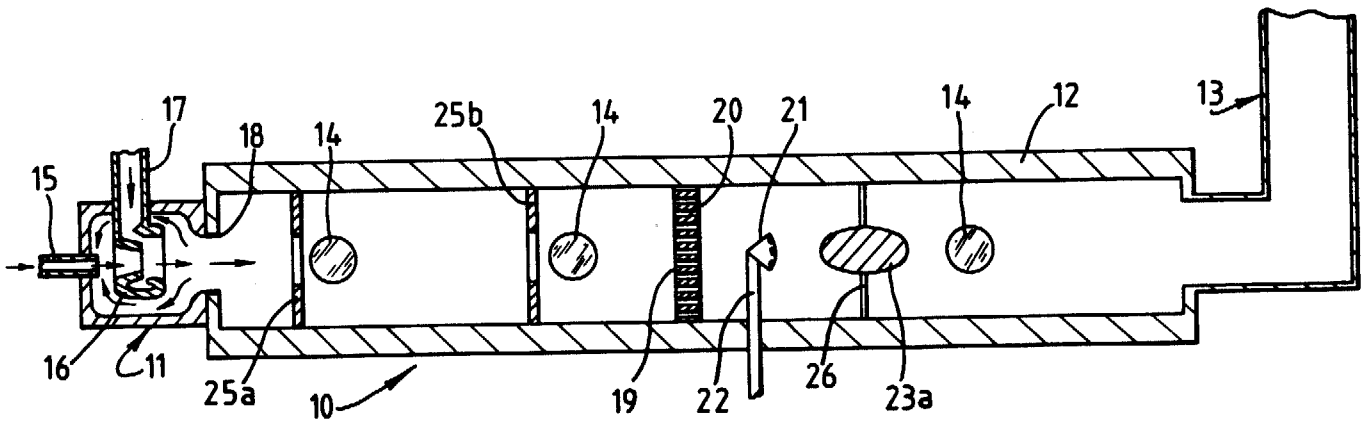
FIG. 1A is a schematic diagrammatic cross-sectional elevation of a variant of the apparatus shown in FIG. 1.

Reference is now made to FIG. 1A in which all parts are the same as in FIG. 1 with the following exceptions:

(1) the first stage flame contacts two refractory baffles 25*a* and 25*b* of annular shape and which are separated by a distance greater than the (local) internal diameter of the combustion chamber 12. Preferably the upstream baffle 25*a* is located at a distance in the range of from 25% to 33% of the length of the first stage flame from the upstream end of the flame at its exit from the burner 11 and entrance into the combustion chamber 12, and the downstream baffle 25*b* is located at a distance in the range of from 50% to 67% of the length of the first stage flame from its upstream end.

(2) the second stage flame contacts an ellipsoidal body 23*a* comprised of refractory material (e.g. alumina-silica) impregnated and coated with a substantially non-volatile catalyst which is active for reducing the $NO_x$ content of the flame gases and/or for inhibiting the formation of $NO_x$. The catalyst may comprise any one or more of the metals hereinbefore stated to be useful for the foregoing purposes, but is preferably either a mixture of iron and chromium oxides or cobalt oxide for cost-effectiveness. The ellipsoidal body 23*a* is aligned with its long axis on the axis of the combustion chamber and supported by refractory coated radial metal wires 26 preferably with at least a major portion of the body 23*a* less than half-way down the second stage flame from its upstream end (which commences at the air outlets of the air injection head 21).

In the embodiments of both FIGS. 1 and 2, the baffle(s) 25 or 25*a* and/or 25*b* may comprise a substantially non-volatile catalyst active for reducing and/or inhibiting the formation of $NO_x$ in the flame.

The invention are expedients which may optionally be employed therewith (as described with reference to FIG. 1) is now described in relation to various desiderata and factors influencing them.

Control of nitrogen oxides ($NO_x$):

$NO_x$ are reduced most effectively when catalysts are used in the interstage zone. Less, but significant further reductions are achieved by placing catalysts within the first and second stage flames.

The data below are quoted for a system where either light fuel oil or gas oil, doped with pyridine to increase the $NO_x$ forming potential to the highest likely to be encountered from any petroleum fuel, was fired with a burner of the type which recirculates a part of the burnt gas into the fresh charge. The combustion chamber was lined with silica/alumina refractory. It was 229 cms (90 in) long and 20.3 cms (8 in.) internal diameter.

Catalyst in interstage zone:

The effect of an iron/chromium catalyst, coated on a perforated alumina/silica refractory block (7.6 cms (3 in.) thick with numerous 1.25 cms (0.5 in.) diameter channels across it), when placed at different positions in the interstage zone, is shown in FIG. 2 and Table 1. The catalyst markedly reduced $NO_x$. Its effect increased the further downstream it was placed, and also as the proportion of fuel-to-air was increased. Table 1 also shows that cobalt oxide, while an effective catalyst, is a less effective catalyst than iron/chromium oxide.

TABLE 1

Influence of interstage catalyst at different distances from the primary burner, and at different air consumption rates (Fuel: Light fuel oil Firing rage, 11.35 l/h (2.5 gall/h)

| Catalyst | Position of catalyst from the primary burner | Air: Actual/ Stoichiometric | NO Reduction % |
|---|---|---|---|
| Fe/Cr | 167.6 cms (66 ins.) | 0.75 | 62 |
| | | 0.80 | 41 |
| | | 0.85 | 25 |
| | 132.3 cms (52 ins.) | 0.75 | 53 |
| | | 0.80 | 34 |
| | | 0.85 | 21 |
| | 101.5 cms (40 ins.) | 0.75 | 44 |
| | | 0.80 | 30 |
| | | 0.85 | 19 |
| Co | 132.3 cms (52 ins.) | 0.75 | 45 |
| | | 0.80 | 30 |
| | | 0.85 | 19 |

Catalyst in the second stage flame:

An iron/chromium oxide treated refractory block similar to that in the interstage zone, but only half its thickness 3.81 cms, (1.5 in.), was placed 7.6 cms (3 ins.) downstream of the air injector. As shown in FIG. 3, this brought about a further reduction in $NO_x$. For instance, with the primary air 73% of the stoichiometric and the overall air input stoichiometric, the second stage catalyst reduced NO from 140 ppm to 120 ppm—a 14% reduction.

A different design of catalyst support—in the form of an elongated ellipsoid with ca 15–25 cms (6 ins.) and 5.08 cms (2 ins.) axes, supported ca 5.08 cms (2 ins.) downstream from the burner (air injector 21 of FIG. 1) along the central axis—produced virtually the same effect as the perforated block catalyst.

Catalyst in the first stage flame:

The use of iron/chromium catalyst in the first stage flame fired by light fuel oil at a rate of 11.35 liters per hour (2.5 Imperial gallons per hour), in a manner similar to that in the second stage flame, substantially reduced $NO_x$ (FIG. 4). For instance, whilst the interstage catalyst, with primary air 74% of stoichiometric, reduced NO from 275 ppm to 115 ppm (58% reduction) the additional first stage catalyst reduced NO to 70 ppm (75% reduction). At this primary air level, second stage combustion with a catalyst therein, produced 100 ppm of NO at an overall stoichiometry of 1.0. A conventional combustion system, with the high nitrogen content fuel used, would generate well over 1000 ppm of NO.

Control of sulphur trioxide:

Formation of sulphur trioxide from any sulphur impurity in the flame is highly undesirable because of its corrosive nature. Combustion according to the invention greatly reduces $SO_3$ formation. For instance, whereas in a conventional system, operating at 2.1% excess oxygen, light fuel oil with 2.5% sulphur content gave rise to 44 ppm of $SO_3$; the modified combustion system, without staging or the use of catalysts, produced 34 ppm of sulphur trioxide (23% reduction) at the same stoichiometry. Staging reduced sulphur trioxide from 34 ppm to 26 ppm. The use of the interstage catalyst reduced it to 20 ppm, and that of the first and second stage catalysts to 18 ppm. Since, unlike the conventional system, staged combustion can be operated smoke-free under stoichiometric conditions, this further greatly reduces sulphur trioxide to only 5 ppm—that is ca 90% overall reduction.

Control of smoke, carbon monoxide, hydrogen and unburned hydrocarbons in the second stage:

For complete combustion of smoke, carbon monoxide, hydrogen and unburned hydrocarbons in the second stage, without any excess air, and in a limited space, thorough mixing of the products of the first stage with the added air should be promoted. The necessary expedients for such mixing are essentially the same as those employed for the first stage. Using the same relatively narrow combustion chamber with baffles in the same manner as in the first stage, satisfactory combustion was successfully effected with stoichiometric air on an overall basis. Smoke emission in the flue gas from the second stage was not greater than 3 Bacharach Number—that is, no smoke was visible in the stack gas. Carbon monoxide, hydrogen and unburned hydrocarbons were absent. And, as previously stated, both $NO_x$ and sulphur trioxide had been reduced by about 90%.

The foregoing description is given to illustrate the invention and is not limitative of its scope.

Reducing Carbon and/or Smoke Formation (Using the "anti-smoke technique"):

In the following description (and related FIGS. 5 to 10 of the drawings) there is now described a combustion technique which may be employed with the method of the invention in order to reduce still further the amount of pollutant in the gas products of part or full combustion and to improve the efficiency of utilization of the fuel. As disclosed above, the combustion technique comprises confining a portion of the first stage flame and/or the second stage flame by means of a laterally bounding combustion chamber so that cross-sectional dimensions of the flame(s) are reduced relative to the cross-sectional dimensions of the flame(s), in the same cross-sectional planes, when the flame(s) are not laterally bounded or confined.

It is preferred that the greatest natural or unconfined cross-sectional dimensions (e.g. diameter) of the flame be reduced by containment in the combustion chamber by from 1.25 cms or thereabouts to 6.3 cms or thereabouts, more preferably 1.8 cms or thereabouts to 5.1 cms or thereabouts. In many cases, the reduction of the flame's greatest cross-sectional dimensions may suitably be from c.2.5 cms (c.1.0 inch) or thereabouts to c.3.8 cms (c.1.5 inches) or thereabouts.

It is preferred that the cross-sectional dimension should not be reduced by more than 25%.

At least 50% of the natural length of the flame is preferably contained or confined by the combustion chamber and more preferably 60% or more (e.g. 70%). Better improvements in combustion may be realized when the combustion chamber laterally confines the upstream part (towards the burner) rather than the downstream part of the flame. The combustion chamber may confine the first stage flame starting from a position either at the exit from the burner or spaced downstream therefrom. It may be convenient to attach the combustion chamber to the burner or burner support.

The combustion chamber may contain at least one internal fixed baffle for promoting recirculation of reactive species in the flame. The, or each, baffle may have any convenient form such as a refractory ring or annulus (in the case of cylindrical combustion chambers) as exemplified by baffle 25, FIG. 1, extending inwardly from the periphery at the internal wall.

The baffle(s) should cause the smallest pressure drop which is economically acceptable for the realized improvement in combustion. For most cases, a pressure drop of up to 5 cms (c.2.0 inches) water will be acceptable. With one baffle, the pressure drop will usually tend to be about 2.5 cms (c.1.0 inch) water in most cases.

When there are two or more baffles, they should be separated by a distance equal to at least the cross-sectional dimension (e.g. diameter or equivalent) of the combustion chamber.

The location of the baffle(s) in the flame tends to influence the improvement in combustion. With one baffle, the baffle should be located preferably less than half-way down the total length of the flame from the burner, e.g. about 33% of the total flame length from the burner.

When two baffles are employed, it is preferred that the upstream baffle is located from 25% to 33% of the length of the flame downstream of the base of the flame, e.g. at the burner in the case of the first stage flame, and the downstream baffle from 50% to 67% of the flame length from the flame base.

With three baffles, the location of the upstream and middle baffles is preferably in the same range as for two baffles, the downstream baffle being located within the flame at any distance downstream of the middle baffle but separated therefrom by a distance no smaller than the internal diameter (or its equivalent) of the combustion chamber.

While the combustion chamber tends to increase the length of the flame, each baffle reduces the flame length so that a shorter combustion chamber can be used to effect the same improvement in combustion. One baffle alone can reduce the flame length by up to 25%, e.g. 15 to 20%, while three baffles can reduce the flame length by up to 50%.

The technique is particularly useful in reducing the amount of air (or other oxygen-containing gas) required to eliminate, or reduce to an acceptable level, smoke or carbon, so that it is possible to burn relatively heavy fuel oils and solid fuels substoichiometrically to produce hot, clean reducing gas relatively efficiently. The technique may also be employed with lighter fuels, e.g. naphthas up to liquefied petroleum gas containing more than 2% of butane, and may also be employed in the combustion of any of the foregoing fuels to produce a substantially smoke- and carbon-free hot neutral (i.e. neither oxidizing nor reducing) gas useful in processes requiring inert gas blanketting and in power generation.

With regard to the latter, the absence of excess air tends to reduce the formation of $SO_3$ from sulphur in the fuel whereby greater heat recovery may be effected without the risk of sulphuric acid corrosion. Moreover, the production of nitrogen oxides also tends to be reduced in the substantial absence of excess air.

The technique will now be described in connection with the production of hot, clean, reducing gases.

Hot reducing atmospheres are extensively generated for heat treatment of metals. Their far wider use in future has been forecast for injection into the bosh zone of blast furnaces and eventually for the production of raw steel by direct reduction of iron ore.

Currently reducing atmospheres are generated mostly by partial combustion of gaseous fuels—natural gas, town gas, propane/butane—in the presence of a catalyst. The operation requires a careful control of fuel and catalyst quality and maintenance of the optimum operating conditions to ensure prevention of carbon formation and deposition on the catalyst.

Much work has already been carried out on improved designs for minimizing carbon formation. What has now been discovered is that a far greater reduction in carbon-forming tendency can be achieved by careful design of the combination chamber. With a suitably designed combustion chamber, in conjunction with a suitable burner, a clean, highly reducing atmosphere can be generated from, e.g., liquid fuels of wide compositional range, without the aid of a catalyst.

In the past, improvements in combustion have arisen from burner modifications which have been chiefly based on promoting better mixing of the fuel and air feed and/or on the injection into the fuel-air feed of water/steam, products of combustion. In contrast, it has been discovered that combustion chamber modifications that increase mixing and recirculation of the flame reactants and products in the flame itself can greatly reduce carbon formation. The combustion chamber design parameters which promote mixing and recirculation have been systematically investigated, and it has been found that these entail:

optimum choice of combustion chamber diameter (or equivalent cross-sectional dimension)

optimum choice of chamber length provision of suitable baffles in the chamber

These features are easy to incorporate and unlike burner modifications, do not require any complex and expensive subsidiary control devices.

Figure 5:
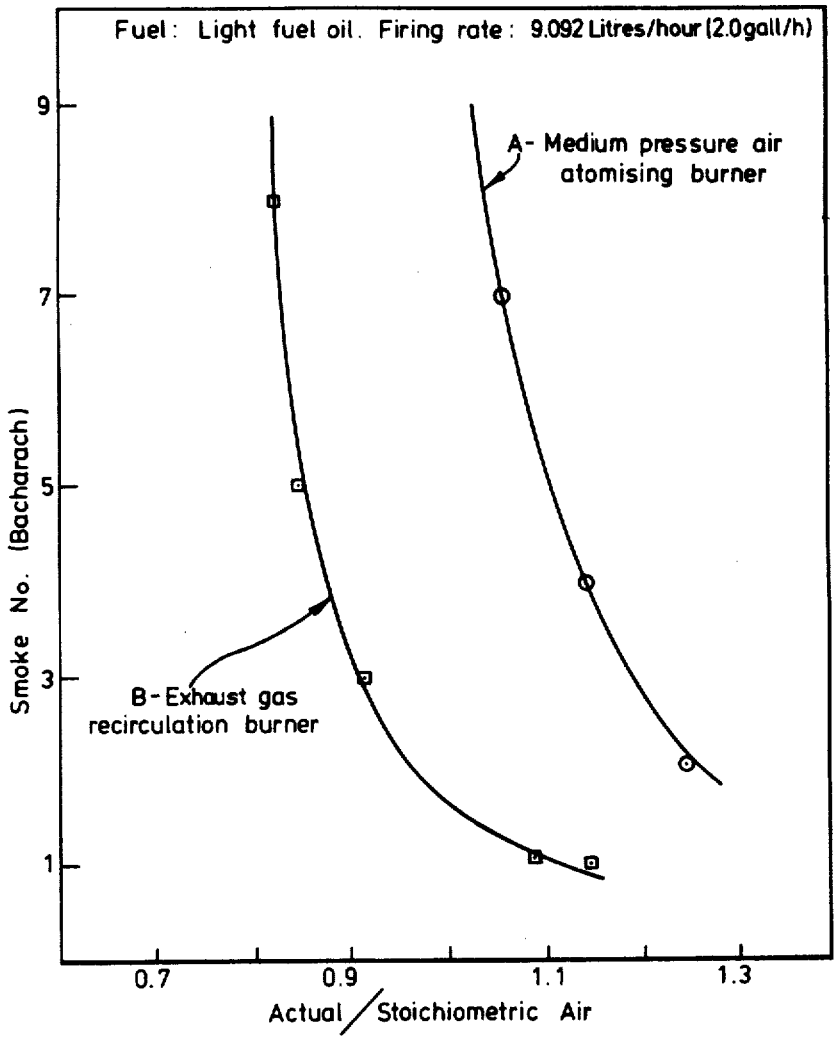
FIG. 5 is a graphical representation of the effects of different types of burner on Bacharach smoke number at different fuel/air ratios.
Figure 6:
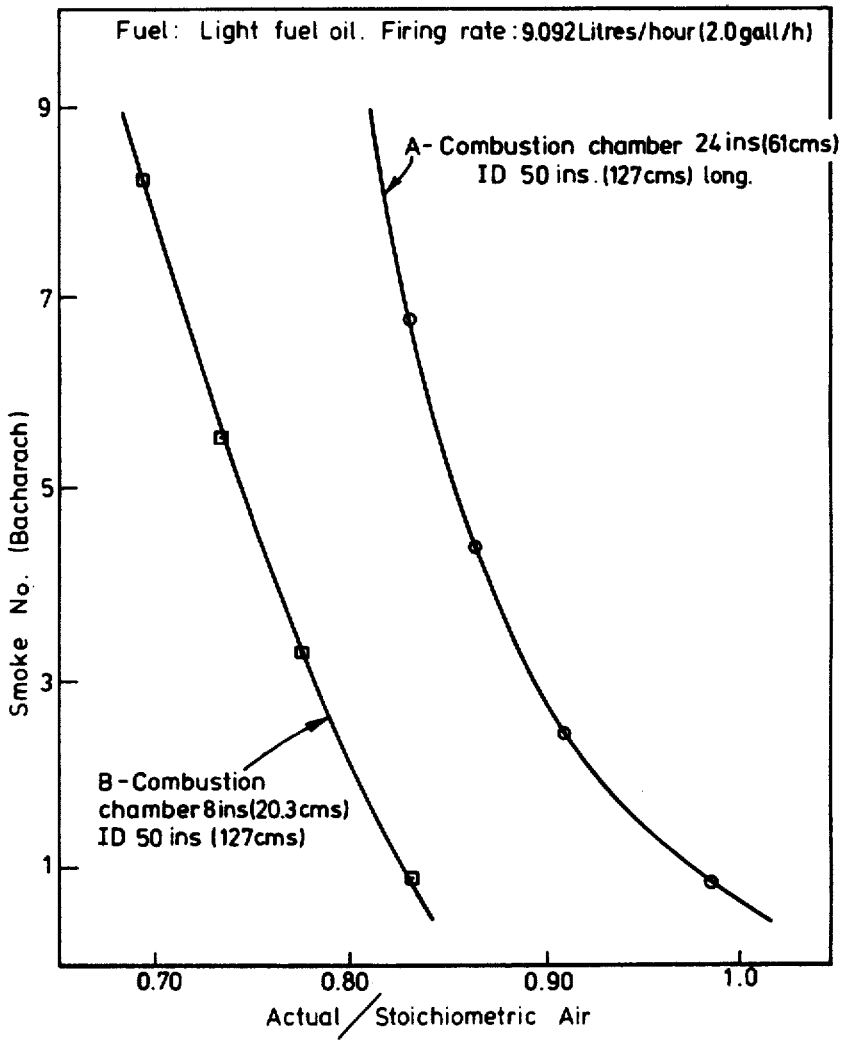
FIG. 6 is a graphical representation of the effects of different diameters of combustion chamber on Bacharach smoke number at different fuel/air ratios.

The effect of combustion chamber modifications was investigated with a burner which recirculates a part of the combustion products into the fuel-air feed described with reference to FIG. 1. This burner produces considerably less carbon than a typical medium pressure air atomizing burner. Comparative results with this burner firing into a refractory lined combustion chamber of conventional size (61 cms (34 inches) diameter and 127 cms (50 inches) long) are shown in FIG. 5, wherein curve A shows the performance of the medium pressure air atomizing burner, and curve B the performance of the exhaust gas recirculation burner. Both burners burned light fuel oil at a rate of 9.09 l/h (2 gallons per hour).

The influence of different parameters on the efficiency of combustion was investigated, as described below.

Influence of Combustion Chamber Diameter:

Using the exhaust gas recirculation burner described with reference to FIG. 1, its smoke emission performance in the 61 cms internal diameter combustion chamber was compared with that in a 20.3 cms (8 ins.) internal diameter chamber of the same length. The narrower diameter chosen was about 2.5 cms (1 in.) smaller than the flame diameter at its widest. The results (FIG. 6) show the markedly less carbon forming tendency in the narrower chamber (curve B) compared with the carbon forming tendency in the wider chamber (curve A). The results were obtained with the same light fuel oil and fuel feed rate (9.09 liters/hour) as used in the tests of FIG. 5.

Studies were next carried out in a still narrower (12.7 cms (5 ins.) internal diameter) chamber. But now the flame length has become far too long to effect complete combustion within the 127 cms (50 ins.) long chamber.

Figure 7:
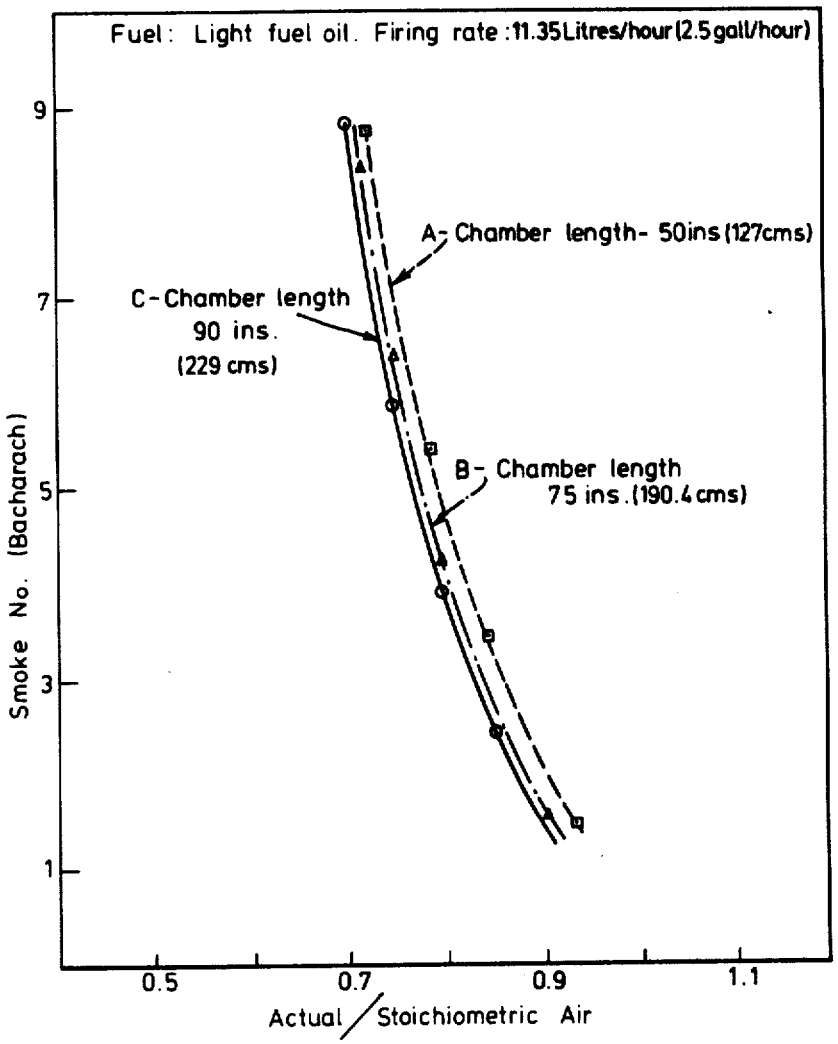
FIG. 7 is a graphical representation of the effects of different combustion chamber lengths on Bacharach smoke number using light fuel oil at different fuel/air ratios.
Figure 8:
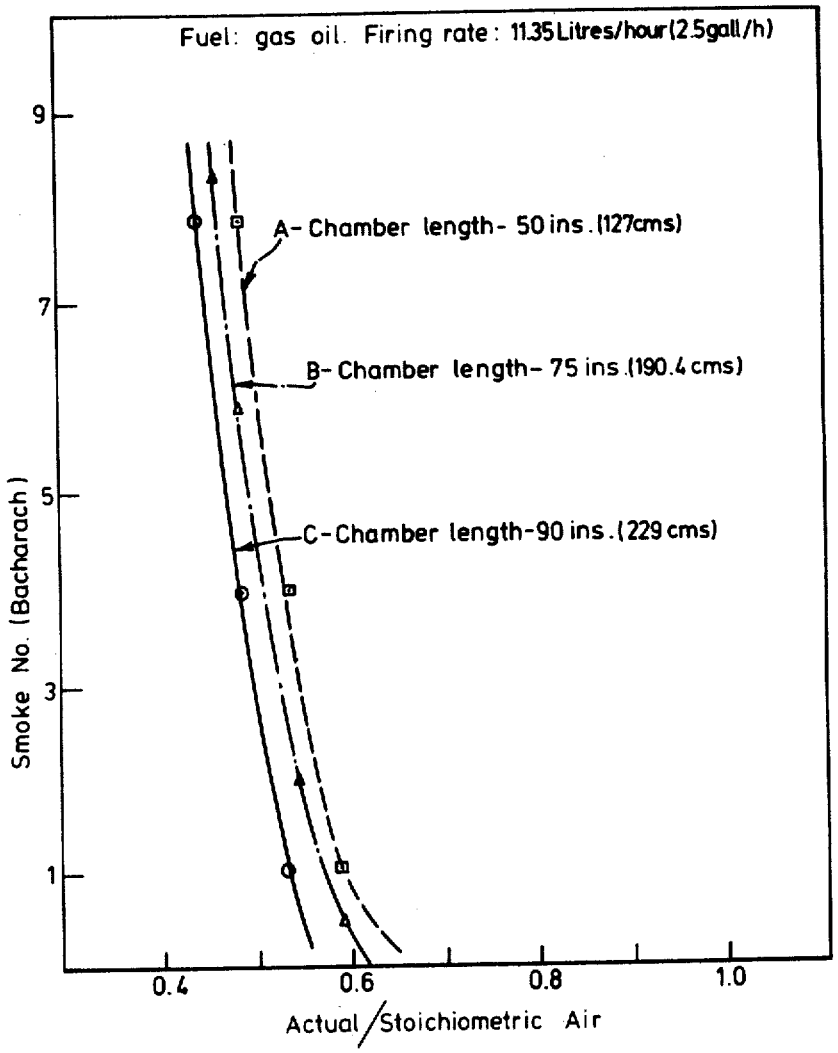
FIG. 8 is a graphical representation like that of FIG. 7 but using gas oil as fuel.
Figure 9:
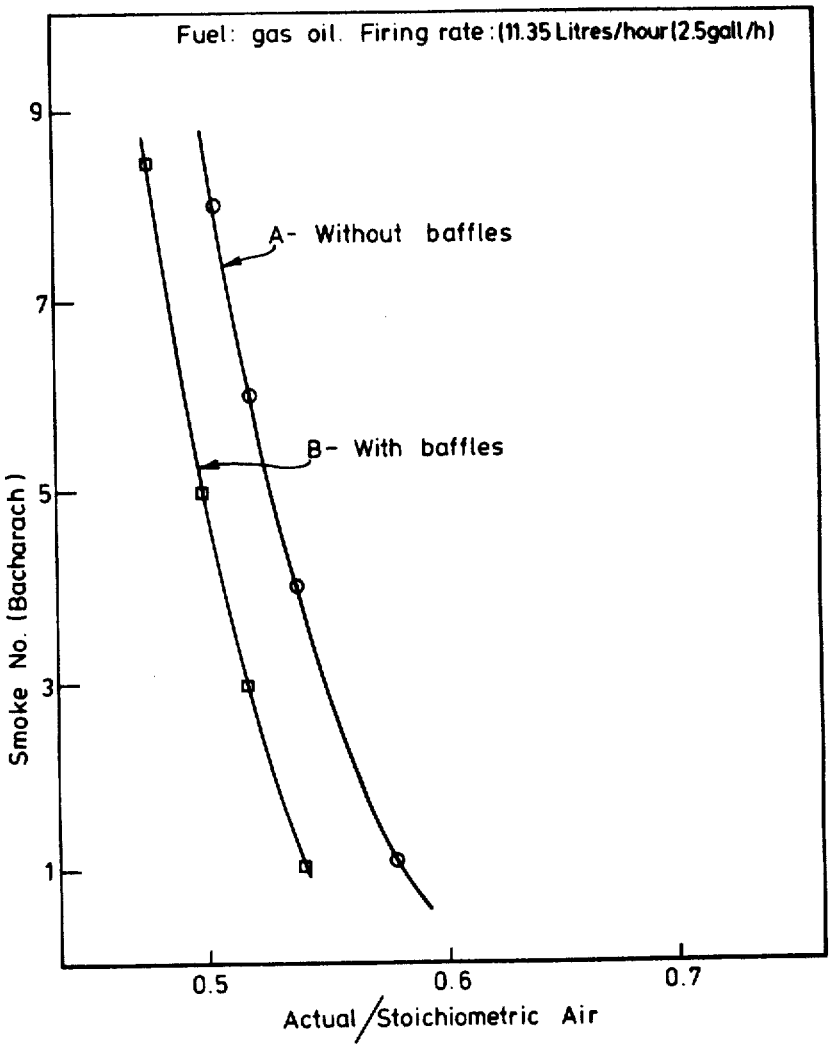
FIG. 9 is a graphical representation of the effects of baffles at different distances from the burner on Bacharach smoke NO for different fuel/air ratios.

Influence of Combustion Chamber Length:

With the 20.3 cms (8 ins.) internal diameter chamber, the influence of increasing the length of the combustion chamber from 127 cms (50 ins.) to 190 cms (75 ins.) and then 229 cms (90 ins.) is shown in FIG. 7 for light oil and in FIG. 8 for gas oil, at a fuel burning rate of about 11.37 liters/hour (2.5 gallons/hour). In FIG. 7, curve A shows the performance using the 127 cms long combustion chamber, curve B that of the 190 cms long chamber and curve C the performance of the 229 cms long chamber. It is seen that an increase in length reduces the carbon-forming tendency, although the effect is less marked than that of reducing the diameter.

Influence of Baffles:

In the 20.3 cms (8 ins.) diameter 127 cms (50 ins.) long combustion chamber, three annular refractory baffles each like baffle 25 of FIG. 1, each with 6.25 cms hole in the centre, were spaced in the combustion chamber at 40.6 cms (16 ins.) 76.2 cms (30 ins.) and 122 cms (48 ins.) from the burner. The burner consumed 11.37 liters/hour (2.5 gallons/hour) of gas oil. These baffles, as shown by curve B of FIG. 9, considerably reduced carbon formation relative to the non-baffled chamber of curve A. The effect, in fact, is greater than that of increasing the length of the flame by confinement in a narrow combustion chamber and thus provides an inexpensive way of reducing carbon forming tendency even with short combustion chambers.

In general, therefore, carbon formation can be markedly reduced by reducing the chamber diameter (or equivalent cross-sectional dimension), increasing the chamber length and by providing baffles in the chamber. Of the three factors, the effect of diameter is most marked. However, care has to be taken that the diameter is not reduced excessively—preferably by not more than 2.5 to 5.1 cms (one-2 inches), or by more than 25% of that of the unrestricted/unconfined flame, since otherwise the resulting excessive inhibition of flame reactions and aerodynamic factors can necessitate the use of an impracticably long combustion chamber for completion of the flame processes. For a given length constraint, carbon formation can be considerably reduced by the insertion of baffles in the chamber. Again, care is necessary that these are not placed so closely as to inhibit the combustion processes to any significant extent. In the system described here by way of example, the position and size of baffles and the diameter of the chamber are particularly suited for maintaining a stable flame even with barely 50% of the stoichiometric air. In conventional systems stable flames are usually hard to maintain with air less than 70% of the stoichiometric.

Figure 10:
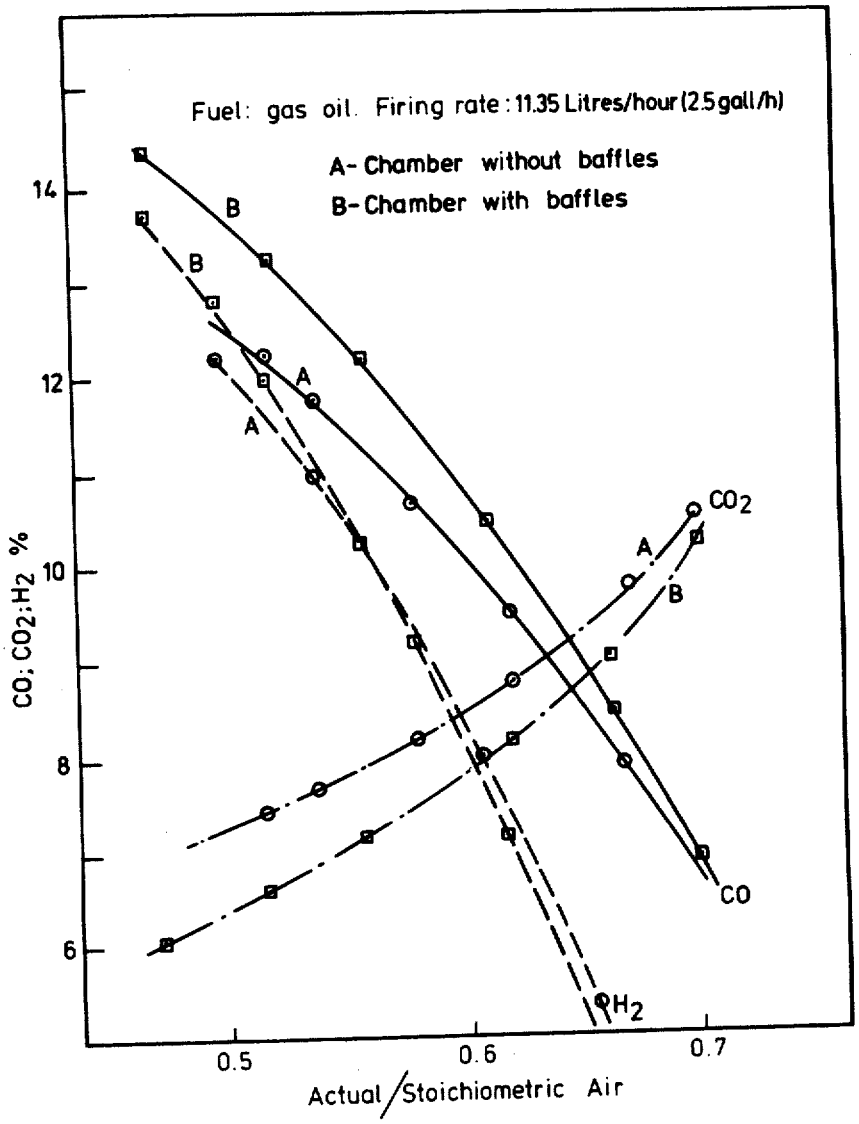
FIG. 10 is a graphical representation of the effects of baffles on the composition of the first stage flame products at different fuel/air ratios.

Successful maintenance of flame process with air barely 50% of the stoichiometric amount produces a highly reducing atmosphere. The amounts of CO and $H_2$ that are formed, along with $CO_2$, are shown in FIG. 10 for gas oil fired at a rate of 11.37 liters/hour (2.5 Imperial gallons/hour) into the 20.3 cms (8 ins.) diameter, 127 cms (50 ins.) long chamber fitted with 3 baffles (curve B) compared with the inferior reducing gas quality produced in the absence of baffles (curve A).

For some applications it is desirable to generate even greater amounts of CO and $H_2$ and correspondingly less of $CO_2$ and $H_2O$. This can be readily achieved by passing the product gas through a bed of incandescent coal in accordance with well known practice.

In the practice of the invention, the pressure drop caused by the combustion chamber, interstage catalyst (and its support), second stage air injector, together with any baffles to be contacted by one or both stage flames should be sufficiently low not to necessitate any significant modification to the burner supplying the flame to the combustion chamber. Preferably, the combustion chamber should not cause a pressure drop greater than 25.5 cms $H_2O$. More preferably, the pressure drop should be less than 12.25 cms water, and may be in the range of from 2 to 10 cms water, e.g. about 6 cms water.

What is claimed is:

1. A method of at least partially burning a hydrocarbon and/or carbonaceous fuel comprising the following steps in sequence:

(a) partially burning the fuel in a first stage flame and producing a substantially carbon-free or smoke-free partially combusted gaseous phase fuel at a temperature of at least 800° C.;

(b) contacting the said partially combusted fuel with a solid, substantially non-volatile catalyst which is active for reducing the amount of nitrogen oxide(s) in the partially combusted fuel, the contacting being effected at a temperature of at least 800° C.; and (c) at least partially burning the partially combusted fuel in a second stage flame to yield hot gaseous products of relatively low pollutant content.

2. A method according to claim 1 comprising contacting at least one of the first and second stage flames with a respective solid, substantially non-volatile catalyst which is active for reducing or inhibiting the formation of nitrogen oxide(s) in the flame(s).

3. A method according to claim 2 in which the hottest region(s) of the flame(s) contacts the said catalyst.

4. A method according to claim 2 in which the or each catalyst contacts the respective flame at a region from 30% to 45% of the length of the flame from its upstream end.

5. A method according to claim 1 in which the or each catalyst comprises a metal selected from iron, chromium, cobalt and a mixture of at least two of the foregoing.

6. A method according to claim 1 in which at least one of the first stage flame and the second stage flame is laterally confined for at least part of its length by a surrounding combustion chamber which reduces the cross-sectional dimensions of at least a portion of the laterally confined part of the flames relative to the cross-sectional dimensions of the flame(s) when not laterally confined.

7. A method according to claim 6 in which the cross-sectional dimensions of the said portion of the laterally confined part of the flame(s) are reduced by not more than 20% relative to the cross-sectional dimensions of the flame(s) when not laterally confined.

8. A method according to claim 6 in which the cross-sectional dimensions of the said portion of the laterally confined part of the flame(s) are reduced by an amount in the range of from 1.00 to 6.50 cms.

9. A method according to claim 1 in which at least one of the first stage flame and the second stage flame contacts at least one baffle disposed for promoting recirculation of reactive species in the flame(s) contacting the said baffle(s).

10. A method according to claim 9 in which the or each respective flame contacts a baffle at a distance less than half way down the length of the flame from its upstream end.

* * * * *